US005192458A

United States Patent [19]

Minemura et al.

[11] Patent Number: 5,192,458

[45] Date of Patent: Mar. 9, 1993

[54] SILICONE GREASE COMPOSITION INCLUDING AN ORGANOMOLYBDENUM COMPOUND

[75] Inventors: Masahiko Minemura, Annaka; Takayuki Takahashi, Myougimachi; Satoshi Kuwata, Annaka, all of Japan

[73] Assignee: Shin-Etsu Chemical Co., Ltd., Tokyo, Japan

[21] Appl. No.: 596,395

[22] Filed: Oct. 12, 1990

[30] Foreign Application Priority Data

Oct. 16, 1989 [JP] Japan ..... 1-269834

[51] Int. Cl.[5] ..... C10M 105/76; C10M 135/18

[52] U.S. Cl. ..... 252/42.7; 252/78.3; 252/49.7; 252/49.6

[58] Field of Search ..... 252/49.6, 49.9, 78.3, 252/43, 565, 42.7, 49.7

[56] References Cited

U.S. PATENT DOCUMENTS

| | | | |
|---|---|---|---|
| 3,579,467 | 5/1971 | Brown | 252/49.6 |
| 3,620,976 | 11/1971 | Wright et al. | 252/49.6 |
| 3,664,953 | 5/1972 | Wright | 252/49.6 |
| 3,673,089 | 6/1972 | Wright | 252/49.6 |
| 4,537,691 | 8/1985 | Mori et al. | 252/49.6 |
| 4,582,620 | 4/1986 | Mori et al. | 252/49.6 |
| 4,755,310 | 7/1988 | Mori et al. | 252/49.6 |
| 4,842,753 | 6/1989 | Mori et al. | 252/49.6 |
| 4,853,139 | 8/1989 | Ichihashi | 252/49.6 |

FOREIGN PATENT DOCUMENTS

| | | |
|---|---|---|
| 190290 | 8/1987 | Japan . |
| 915453 | 11/1984 | U.S.S.R. . |
| 2185492A | 1/1987 | United Kingdom . |

OTHER PUBLICATIONS

Database WPIL, No. 86-059768.

*Primary Examiner*—Jacqueline Howard
*Assistant Examiner*—J. Silbermann
*Attorney, Agent, or Firm*—Finnegan, Henderson, Farabow, Garrett & Dunner

[57] ABSTRACT

A silicone grease composition comprising an organosiloxane containing long-chain alkyl groups, a thickener, and an organomolybdenum compound is disclosed.

The silicone grease composition is excellent not only in heat and cold resistance, oxidation resistance, chemical stability and low-load lubricity but also in high-load (extreme-pressure) lubricity.

4 Claims, No Drawings

SILICONE GREASE COMPOSITION INCLUDING AN ORGANOMOLYBDENUM COMPOUND

BACKGROUND OF THE INVENTION

The present invention relates to a silicone grease composition, particularly to a silicone grease composition excellent in extreme-pressure (high-load) lubricity.

Silicone oils, particularly dimethyl silicone oils and methyl phenyl silicone oils are so excellent in viscosity-to-temperature relationship, heat and oxidation resistance, shear stability and chemical stability that greases based on these silicone oils also exhibit excellent temperature characteristics, heat resistance, oxidation resistance and chemical stability, thus having been favorably used as lubricants.

However, because the silicone oils are inferior to mineral or synthetic oils in boundary lubricity such as steel-to-steel lubricity, they are unsatisfactory for use under high-speed and high-load conditions and the use thereof is extremely limited. Therefore, there have been made various attempts to improve the boundary lubricity of a silicone oil by adding an oiliness improver or extreme-pressure additive such as a fatty acid or a derivative thereof or a chlorine, fluorine, phosphorus, or amine compound. For example, there have been proposed a process of adding a chlorinated paraffin or a dialkyl chlorendate (see Japanese Patent Publication No. 51-38864) and a process of adding 1,2,3,4,7,8,9,10,13,13,14,14-dodecachloro-1,4,4a,5,6-,6a,7,10,10a,11,12,12a-dodecahydro-1,4;7,10-dimethanodibenzo[a,e]cyclooctene (see Japanese Patent Laid-Open No. 62-283196).

However, no satisfactory boundary lubricity has been attained as yet even by these attempts. A grease composition containing as a base oil a silicone oil containing long-chain alkyl groups (see U.S. Pat. Nos. 3,579,467 and 3,673,089) exhibit excellent lubricity under low-load conditions, but it cannot exhibit sufficient lubricity under high-load conditions. Therefore, further improvement in the high-load lubricity has been expected.

Accordingly, it is an object of the present invention to provide a silicone grease composition excellent not only in heat and cold resistance, oxidation resistance, chemical stability and low-load lubricity but also in extreme-pressure (high-load) lubricity.

It has now been found by the inventors of the present invention that the object is accomplished by the addition of an organomolybdenum compound to a silicone grease composition containing as a base oil a silicone oil containing long-chain alkyl groups.

SUMMARY OF THE INVENTION

The grease composition of the present invention comprise:

1) 100 parts by weight of an organopolysiloxane containing long-chain alkyl groups represented by the general formula I:

$$R^1_aR^2_b[R^3(CH_2)_n]_cSiO_{\frac{4-a-b-c}{2}} \quad (I)$$

and exhibiting a viscosity of from 10 to 10,000 cSt at 25° C.;

2) 1 to 60 parts by weight of a thickener; and 3) 5 to 30 parts by weight of an organomolybdenum compound.

In the formula I, $R^1$ is a monovalent, saturated or unsaturated hydrocarbon group having 4 to 20 carbon atoms, preferably 6 to 14 carbon atoms; $R^2$ is a monovalent group selected from among monovalent, saturated or unsaturated hydrocarbon groups each having 1 to 3 carbon atoms, and substituted or unsubstituted aryl groups; $R^3$ is a monovalent organic group having a hindered phenol structure selected from among those represented by the formulas:

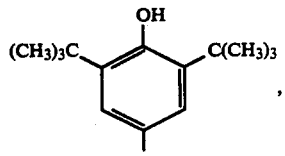

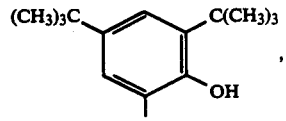

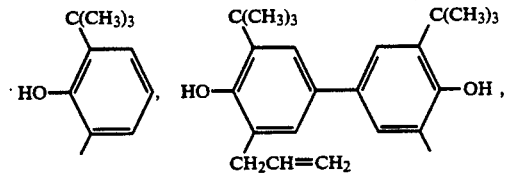

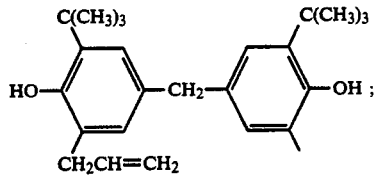

a has a value of from 0.3 to 1.0; b has a value of from 1.0 to 2.0; c has a value of from 0 to 0.05; the sum of (a+b+c) has a value of from 1.8 to 2.3; and n has a value of from 1 to 5.

DETAILED DESCRIPTION OF THE PREFERRED EMBODIMENTS

As stated in the above, $R^1$ in the general formula I is a monovalent, saturated or unsaturated hydrocarbon group having 4 to 20 carbon atoms, preferably 6 to 14 carbon atoms.

If $R^1$ has less than 4 carbon atoms, the lubricity will not be sufficiently improved, while if it has more than 20 carbon atoms, the resulting grease will exhibit poor low-temperature characteristics which are unfavorable as grease characteristics.

Particular examples of $R^2$ in the general formula I include methyl, ethyl, propyl, trifluoropropyl, phenyl and chlorophenyl groups, among which a methyl group is particularly preferable.

In the above, five monovalent organic groups having a hindered phenol structure are shown as $R^3$ in the general formula I. In these groups, the t-butyl group is adjacent to the hydroxyl group and hinders its reactivity.

If a is less than 0.3, no sufficient lubricity will be imparted to the grease composition, while if it is more than 1.0, the resulting grease composition will exhibit poor low-temperature characteristics. On the contrary, if b is less than 1.0, the low-temperature characteristics of the resulting grease composition will be poor, while if it is more than 2.0, no sufficient lubricity will be attained. Furthermore, c must be at most 0.05, because no additional remarkable improvement in the heat resistance can be attained even if it exceeds 0.05, and the use of an organopolysiloxane having such a high c value is uneconomical. It is preferable that c exceeds 0, because the heat resistance of the organopolysiloxane containing long-chain alkyls is enhanced by introducing a hindered phenol group thereinto. The organopolysiloxane having the general formula I can be prepared by using a method such as that disclosed in U.S. Pat. No. 3,673,089, the teachings of which are hereby incorporated by reference.

The thickener to be used in the present invention as the second component is not particularly limited, but may be arbitrarily selected from among ones conventionally used by those skilled in the art. Particular examples thereof include metal salts of higher fatty acids, silica, urea, zinc oxide and alumina. Among these, metal salts of higher fatty acids are preferred and lithium myristate, lithium stearate and lithium 12-hydroxystearate are particularly preferred. Many examples of the thickener are also disclosed in U.S. Pat. No. 3,673,089.

Since the thickener is a component for enhancing the thixotrophy of the grease, the amount thereof is not particularly limited, but may vary depending upon the viscosity of the base oil and the consistency desired. Generally, the amount is preferably 1 to 60 parts by weight, particularly preferably 10 to 30 parts by weight.

The organomolybdenum compound to be used in the present invention as the third component serves to impart extreme-pressure (high-load) lubricity to the silicone oil. Preferred examples thereof include molybdenum dithiocarbamate and molybdenum dithiophosphate, among which molybdenum dithiocarbamate [trade name: ADEKA SAKURA-LUBE 500 and ADEKA SAKURA-LUBE 600(products of Asahi Denka Kogyo K.K.)] are particularly preferable. The amount of the organomolybdenum compound is preferably 3 to 30 parts by weight, particularly preferably 5 to 15 parts by weight.

If the amount is less than 3 parts by weight, only insufficient extreme-pressure lubricity will be attained, while if it is more than 30 parts by weight, neither remarkable additional improvement in the extreme-pressure lubricity will be attained, nor the use of such a large amount thereof is economical.

Of course, the grease composition of the present invention may further contain various additives which have been known to be available for such purposes, in addition to the three components described above, so far as the performance of the grease is not adversely affected. The examples thereof include oiliness improvers such as higher fatty acids, fats and oils and ester oils; antioxidants such as amines, phenols, sulfur compounds and phosphorus compounds; and extreme-pressure additives other than organomolybdenum compounds.

The silicone grease of the present invention can be easily prepared by homogeneously mixing and dispersing the components described above together by a known method.

The silicone grease composition of the present invention prepared above contains as a base oil an organopolysiloxane containing long-chain alkyl groups, so that it is excellent in heat and cold resistance, oxidation resistance, chemical stability and low-load lubricity. Further, since the grease composition contains a specified amount of an organomolybdenum compound, it is improved in high-load lubricity to exhibit excellent steel-to-steel extreme-pressure lubricity.

The present invention will now be further described by referring to the following Examples. These are illustrative of the practice of the present invention and are not intended for purposes of limitation.

EXAMPLES 1 to 5

100 parts by weight of decyl(3,5-di-t-butyl-4-hydroxyphenylpropyl)methylsilicone (A) (viscosity at 25° C. : 350 cSt) represented by the formula:

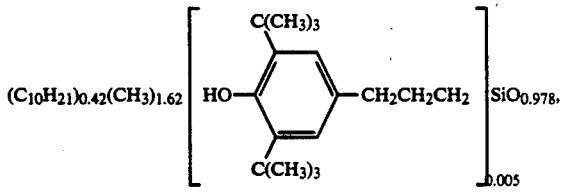

and 30 parts by weight of lithium stearate were stirred together while heating at 180° to 210° C. for 2 hours and cooled to a room temperature, followed by the addition of 5 to 30 parts by weight [10 parts by weight (Example 1), 5 parts by weight (Example 2), 15 parts by weight (Example 3), 25 parts by weight (Example 4), and 30 parts by weight (Example 5)] of molybdenum dithiocarbamate [trade name: ADEKA SAKURA-LUBE 600 (a product of Asahi Denka Kogyo K.K.)]. The obtained mixture was further mixed to obtain a homogeneous alkyl-modified silicone grease composition.

This silicone grease composition was examined for weld load under conditions of 1500 rpm, one minute and room temperature and for wear track diameter under conditions of 1000 rpm, 40 kgf, five minutes and room temperature according to the four-ball lubricant test. The results are given in Table 1.

TABLE 1

| | Composition | | | Results of lubricity test | |
|---|---|---|---|---|---|
| | organopolysiloxane | lithium stearate | molybdenum dithio-carbamate | weld load (kgf)*1 | wear track diameter (mm)*2 |
| Example 1 | (A)*: 100 pt. by wt. | 30 pt. by wt. | 10 pt. by wt. | 316 | 0.45 |
| Example 2 | (A): 100 pt. by wt. | 30 pt. by wt. | 5 pt. by wt. | 316 | 0.40 |
| Example 3 | (A): 100 pt. by wt. | 30 pt. by wt. | 15 pt. by wt. | 355 | 0.45 |
| Example 4 | (A): 100 pt. by wt. | 30 pt. by wt. | 25 pt. by wt. | 398 | 0.47 |
| Example 5 | (A): 100 pt. by wt. | 30 pt. by wt. | 30 pt. by wt. | 398 | 0.45 |
| Example 6 | (B)*: 100 pt. by wt. | 30 pt. by wt. | 10 pt. by wt. | 316 | 0.42 |
| Comparative Example 1 | (A): 100 pt. by wt. | 30 pt. by wt. | 0 pt. by wt. | 158 | 0.40 |
| Comparative | (A): 100 pt. by wt. | 30 pt. by wt. | 2 pt. by wt. | 200 | 0.42 |

TABLE 1-continued

| | Composition | | | Results of lubricity test | |
|---|---|---|---|---|---|
| | organopolysiloxane | lithium stearate | molybdenum dithio-carbamate | weld load (kgf)*1 | wear track diameter (mm)*2 |
| Example A | | | | | |

[Notes]
(A): decyl(3,5-di-t-butyl-4-hydroxyphenylpropyl)methylsilicone described in Examples 1 to 5
(B): decylmethylsilicone described in Example 6
*1: 1500 rpm/one minute/room temperature
*2: 1000 rpm/40 kgf/5 minutes/room temperature

EXAMPLE 6

A silicone grease composition was prepared by the same procedure as that of Example 1 except that the decyl-(3,5-di-t-butyl-4-hydroxyphenylpropyl)methylsilicone (A) was replaced by decylmethylsilicone (B)(viscosity at 25° C.: 400 cSt) represented by the formula:

$$(C_{10}H_{21})_{0.425}(CH_3)_{1.62}SiO_{0.978},$$

and examined for weld load and wear track diameter in the same manners as those of Example 1. The results are given in Table 1.

Comparative Examples 1 and 2

The same procedure as that of Example 1 was repeated except that the amount of molybdenum dithiocarbamate was reduced to obtain alkyl-modified silicone grease compositions. The grease compositions were examined for weld load and wear track diameter in similar manners to those of Example 1. The results are given in Table 1.

The results given in Table 1 have proved that the weld load and the extreme-pressure lubricity can be remarkably enhanced when the amount of the organomolybdenum compound added is 5 parts by weight or above.

Comparative Example 3

A silicone grease composition was prepared in the same manner as that of Example 1 except that the decyl(3,5-di-t-butyl-4-hydroxyphenylpropyl)methylsilicone (A) was replaced by methylphenylsilicone, and examined for weld load and wear track diameter in similar manners to those of Example 1. It revealed that the former was 316 and the latter is 1.2.

Comparative Example 4

An alkyl-modified silicone grease composition was prepared by the same procedure as that of Example 1 except that the molybdenum dithiocarbamate was replaced by dialkyl chlorendate, and examined for weld load and wear track diameter in similar manners to those of Example 1. It revealed that the former was 141 and the latter was 0.50.

Comparative Example 5

An alkyl-modified silicone grease was prepared in the same manner as that of Example 1 except that the molybdenum dithiocarbamate was replaced by molybdenum disulfide, and examined for weld load and wear track diameter in a similar manner to that of Example 1. It revealed that the former was 200 and the latter was 0.48.

Comparative Example 6

An alkyl-modified silicone grease composition was prepared in the same manner as that of Example 1 except that the molybdenum dithiocarbamate was replaced by 1,2,3,4,7,8,9,10,13,13,14,14-dodecachloro-1,4,4a,5,6,6a,7, 10,10a,1,12,12-dodecahydro-1,4;7,10-dimethanodibenzo-[a,e]cyclooctene (trade name: Dechlorane Plus #25, a product of Occidental Chemical Corporation), and examined for weld load and wear track diameter in similar manners to those of Example 1. It revealed that the former was 158 and the latter was 0.62.

The results of the foregoing Examples and Comparative Examples have proved that the silicone grease composition of the present invention not only has a high weld load, i.e., an excellent extreme-pressure lubricity, but also exhibits a small wear track diameter under a low load (40 kgf), i.e., an excellent lubricity.

What is claimed is:

1. A silicon grease composition comprising;

(A) 100 parts by weight of decyl(3,5-di-t-butyl-4-hydroxyphenylpropyl)methylsilicone having a viscosity of about 350 cSt at 25° C. and represented by the following formula:

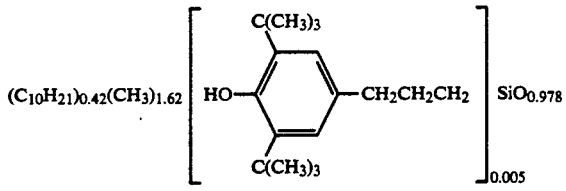

(B) 1 to 60 parts by weight of a thickener; and (C) 3 to 30 parts by weight of molybdenum dithiocarbamate.

2. The silicone grease composition of claim 1, wherein the thickener is selected from the class consisting of lithium myristate, lithium stearate, and lithium 12-hydroxystearate.

3. The silicone grease composition of claim 1, wherein the thickener is contained in an amount of 10 to 30 parts by weight based on 100 parts by weight of the organopolysiloxane.

4. The silicone grease composition of claim 1, wherein the molybdenum dithiocarbamate is contained in an amount of from 5 to 15 parts by weight based on 100 parts by weight of the silicone compound.

* * * * *